United States Patent [19]

Snow

[11] 4,218,807

[45] Aug. 26, 1980

[54] DOOR STOP

[76] Inventor: A. Ray Snow, 8706 Acorn La., Sandy, Utah 84070

[21] Appl. No.: 972,606

[22] Filed: Dec. 22, 1978

[51] Int. Cl.[2] ..... E05F 5/08

[52] U.S. Cl. ..... 16/86 A; 292/DIG. 19

[58] Field of Search ..... 16/82, 85, 86 A, 86 C, 16/DIG. 17, DIG. 21; 292/DIG. 19

[56] References Cited

U.S. PATENT DOCUMENTS

| | | | |
|---|---|---|---|
| 1,394,889 | 10/1921 | Foedisch et al. | 16/86 A |
| 1,481,582 | 1/1924 | Woolliscroft | 16/86 A X |
| 2,449,687 | 9/1948 | Brinda | 16/85 |
| 2,479,597 | 8/1949 | Anton | 16/85 X |
| 2,540,630 | 2/1951 | Munro | 16/86 A |
| 3,173,826 | 3/1965 | Campbell et al. | 16/86 A UX |
| 3,180,666 | 4/1965 | Jorgensen | 16/85 X |
| 3,243,836 | 4/1966 | Reiss | 16/85 |
| 3,311,338 | 3/1967 | Culley | 16/86 A UX |

*Primary Examiner*—C. J. Husar
*Assistant Examiner*—Moshe I. Cohen
*Attorney, Agent, or Firm*—Lynn G. Foster

[57] ABSTRACT

A door stop and method which insures damping of the inertia of a swinging door without damage to either the door or the door stop, the door stop comprising a static member mounted to a wall or a door and a dynamic member having a hollow body which reciprocably receives guide structure of the static member, the dynamic member also comprising a bumper which upon engagement with the door or the wall causes reciprocation of the two members.

7 Claims, 6 Drawing Figures

DOOR STOP

BACKGROUND

1. Field of Invention

The present invention relates generally to door stops and more particularly to novel door stops and related methods by which the force of a swinging door is reciprocably damped without damage to the door or the stop.

2. Prior Art

So far as known, only two basic types of door stops have been commercially available. One comprises a rigid elongated stop member having an elastomeric tip at the cantilevered end. Upon impact, dents and impressions are continuously caused to be made in the door or the wall or both.

The other door stop is somewhat similar in its general appearance but the body thereof is formed of a helically coiled wire-like material. Thus, a certain amount of resiliency is created when the door strikes the spring stop, so long as perfect or nearly perfect alignment is maintained. To the contrary, these stops are readily damaged and deformed during ordinary use. For example, they are often centrally and permanently bent out of alignment with the door so as to be of limited or no value and, further, when in such condition, causing scratching, maring and other forms of undesirable wear upon the door and/or the wall.

BRIEF SUMMARY AND OBJECTS OF THE INVENTION

In brief summary, the present invention comprises a novel door stop and related method which avoid damage to doors, walls and the door stop itself, which can be easily and correctly installed by a non-technical person, which is economical, reliable and durable, which is attractive and which acts to repeatedly damp door impact to avoid damage, as mentioned, and to substantially reduce impact noise. The door stop comprises a static mountable member and a reciprocable dynamic member, the two members providing alignment guide structure to insure displacement of one member in respect to the other caused by door impact.

With the foregoing in mind, it is a primary object of the present invention to provide a novel door stop and related method.

A further important object of the present invention is to provide a novel door stop and method which avoid damage to doors, walls and the door stop itself.

An additional paramount object according to the present invention is the provision of a novel door stop and related method which accommodate easy and correct installation by a non-technical person.

A further primary object is the provision of an improved door stop and related method which is economical, reliable and durable.

A further object according to the present invention is the provision of a novel door stop which is attractive.

Another dominant object of the present invention is the provision of a novel door stop and related method which act to repeatedly damp door impact to avoid damage and substantially reduce impact noise.

A further significant object is the provision of a novel door stop comprising a static mountable member and a dynamic member which members are interrelated by guide structure to insure reciprocation without damage responsive to door impact.

These and other objects and features of the present invention will be apparent from the detailed description taken with reference to the accompanying drawings.

DETAILED DESCRIPTION OF THE ILLUSTRATED EMBODIMENT

Figure 1:
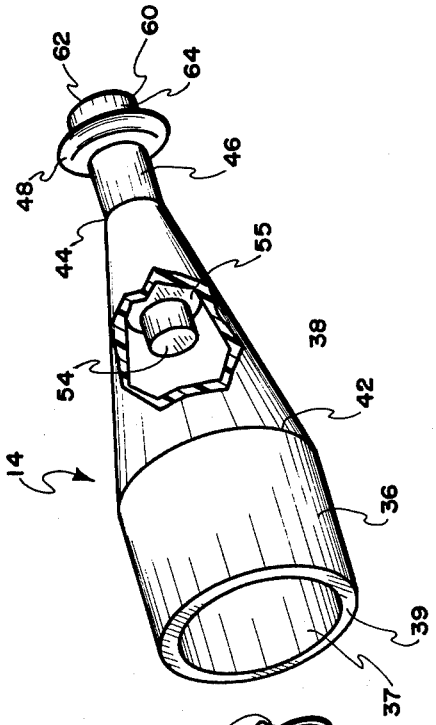
FIG. 1 is an exploded perspective of a presently preferred door stop embodiment according to the present invention.
Figure 1:
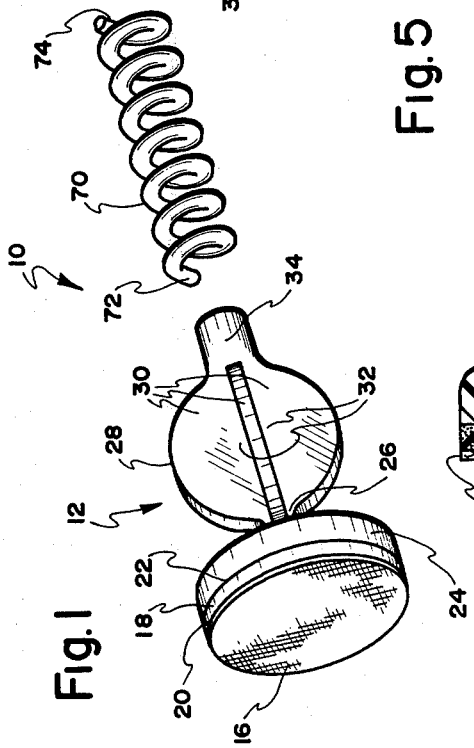
Figure 6:
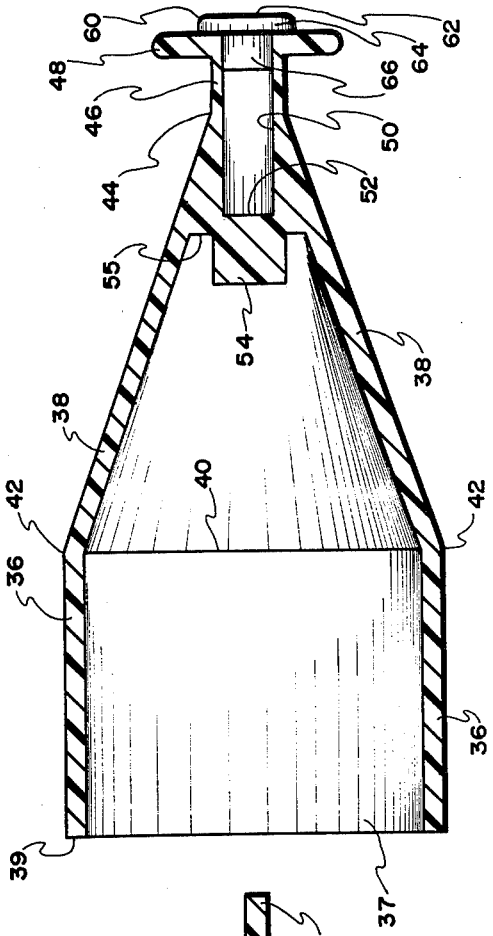
FIG. 6 is a longitudinal cross section of the dynamic member of the door stop of FIG. 1.
Figure 5:
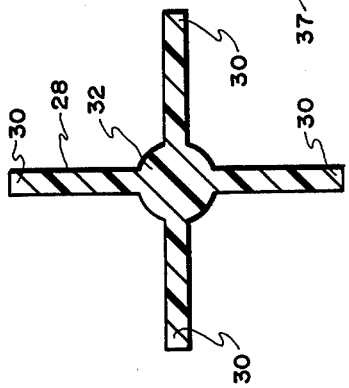
FIG. 5 is a cross section of the alignment guide structure of the static member of the door stop of FIG. 1.
Figure 4:
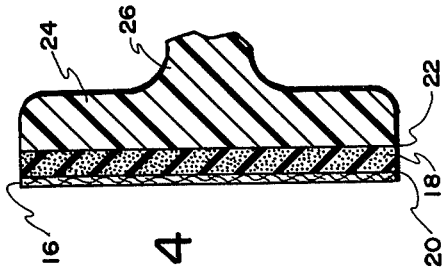
FIG. 4 is an enlarged fragmentary cross section of the mounting base of the static member of the door stop of FIG. 1.

Reference is now made to the drawings wherein like numerals are used to designate like parts throughout and which illustrates a presently preferred door stop assembly, generally designated 10. The door stop assembly comprises a static mount member, generally designated 12, a dynamic member, generally designated 14, a compression spring 70 and an elastomeric bumper 60 carried at the distal cantilevered tip of the dynamic member 14.

More specifically, static mount member 12 is illustrated as comprising, at the proximal end thereof, a fabric or other suitable removable cover 16 disposed adjacent and having equal diameter to a mounting pad 18 of foam or sponge material. Preferably mounting pad 18 comprises an elastomeric material available from the 3M company and comprises adhesive over its fore and aft faces 20 and 22, respectively. Thus, when the cover 16 is manually removed, the adhesive layer 20 accommodates substantially permanent press-mounting of the static member 12 on the surface of the door or on a wall so as to be in substantial perpendicular alignment with the curvilinear path traversed by the door when displaced between its closed and fully open positions. Other fastening structure may be used if desired to mount the static member in a selected position.

The second adhesive face 22 of the mounting layer 18 is caused to be firmly secured to a disc base 24 of the static mount member 12. The disc base 24 is preferably of rigid plastic material. The diameter of base 24 is illustrated as being the same as the diameter of the resilient mounting member 18.

The disc base 24 integrally merges with a transition neck 26. The neck 26 in turn integrally merges with a guide structure 28 which comprises a central axially extending core 32 and four semi-curvilinear radial flanges disposed at 90 degrees with respect to each other. Each flange 30 may be arcuate, elliptical or of any other curvilinear configuration such that the illustrated guide structure 28 defines a biaxial maximum lateral dimension to accommodate snug reciprocation and pivoting as needed of the dynamic member 14 in respect thereof, as hereinafter more fully described.

The guide structure 28 integrally merges with the cylindrical projection 34, which constitutes the distal end of the static mount member 12. The diameter of the projection 34 is sized so as to snugly fit within the inside diameter of the proximal end 72 of the helical coiled compression spring 70 (as best illustrated in FIGS. 2 and 3).

The dynamic member 14 comprises at its proximal end a hollow right circular cylindrical barrel 36 having a proximal opening 37 adjacent the proximal edge 39, the diameter of which is only slightly greater than the maximum lateral dimension of the guide structure 28 of the static mount member 12. The axial length of the barrel 36 is selected to equal or slightly exceed the displacement distance traversed between fully extended position (shown in FIG. 2) and the fully retracted position (shown in FIG. 3). The barrel 36 terminates at its distal end in an angular internal transition angle or site 40 and at an external transition angle or site 42. The two angle transitions 40 and 42 are radially aligned one with the other.

The barrel, at sites 40 and 42 integrally merges with a hollow conical section 38, the length of which is selected to be consistent with the distance of reciprocation of the door stop assembly 10 taking into account the overall length of the compression spring 70.

Figure 2:
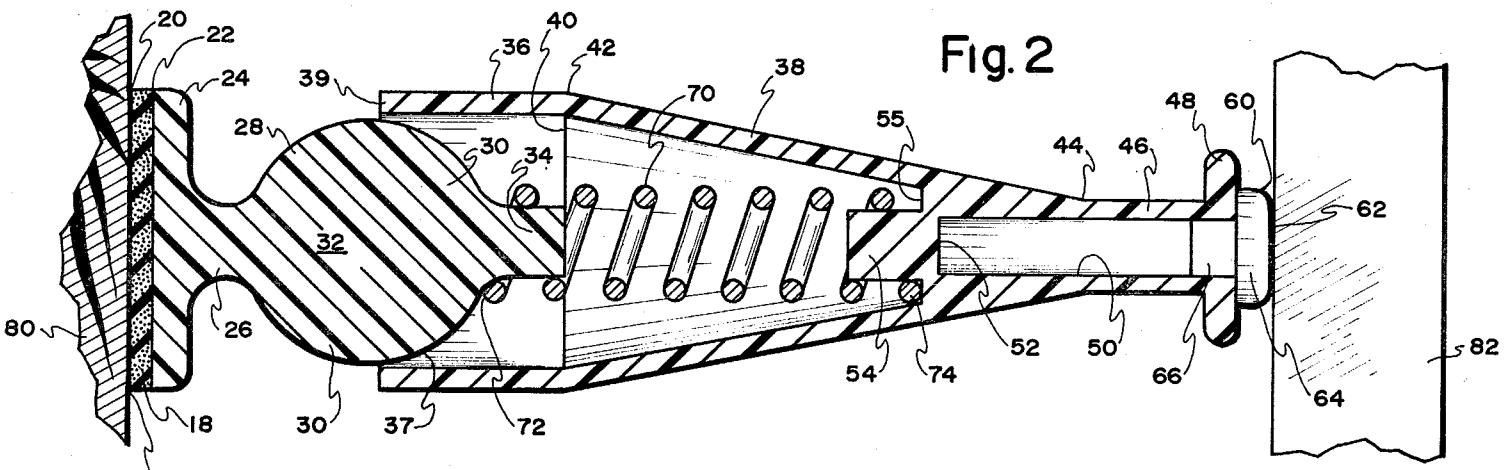
FIG. 2 is an enlarged longitudinal cross section of the assembled door stop of FIG. 1 shown in its fully extended position.
Figure 3:
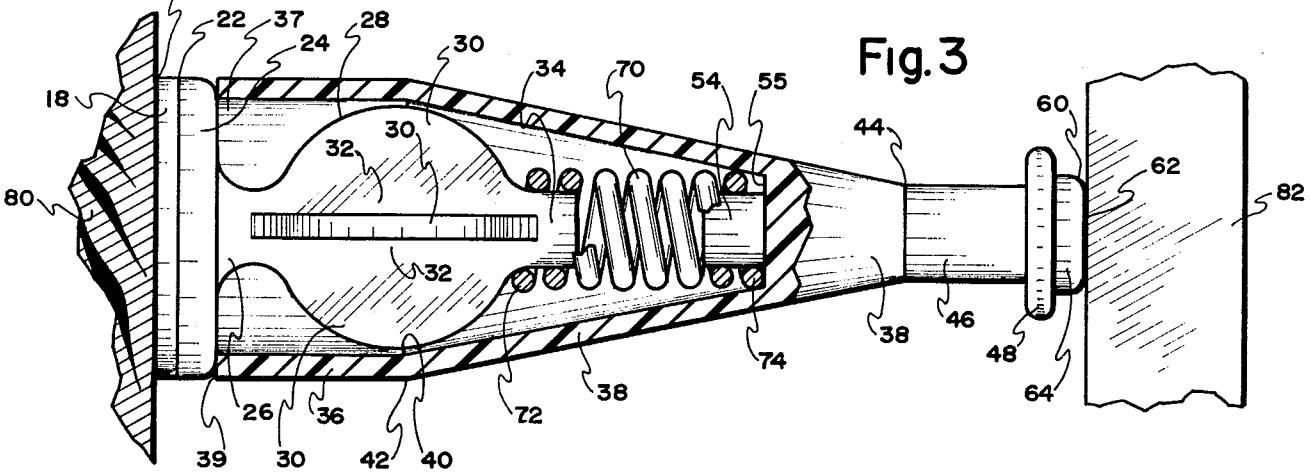
FIG. 3 is a side elevation, similar to FIG. 2 with parts broken away for clarity of illustration, depicting the door stop of FIG. 1 in its fully retracted position caused by door impact.

The conical section 38 terminates in an exterior angle transition site 44 and internally defines a radial annular face 55 and a rearwardly extending axial projection 54 the length and diameter of which are selected to accommodate receipt of the distal end 74 of the spring 70 in snug, though removable relation, as illustrated in FIG. 2.

Forward of the projection 54 comprises an axial blind bore 50 comprising a base 52.

The conical tapered portion 38 merges at site 44 with an axial hollow annulus 46, the hollow interior of which constitutes a continuation of the blind bore 50, mentioned earlier. The inside and outside diameters of the hollow section 46 are of equal diameter, respectively, throughout and merge with a radial flange 48. Flange 48 constitutes the distal end of the dynamic member 14.

The blind bore 50 extends through and is centrally exposed at the distal face of the flange 48. The rubber stop insert or bumper 60, preferably formed of yieldable vinyl is illustrated as being press fit into the distal end of the blind bore 50. The proximal diameter of the rearward cylindrical extension 66 of the bumper 60 having a diameter slightly greater than the diameter of the blind bore 50 to accommodate said press fit, with the bumper 60 being radially enlarged at exposed flange 64.

Accordingly, the impact of the door during its swinging against the door stop assembly 10, when properly mounted, is imposed directly upon the exposed distal face 62 of the bumper 60. This is true independent of whether or not the door stop assembly is mounted at its proximal end to a wall 80, (in which case the door will swing an impact against the bumper 60) or is mounted to the door 82 (so that the bumper 60 is caused to impact against an adjacent wall or the like).

The door stop assembly 10 may be readily mounted to the door 82 or to the wall 80 or the like, as mentioned, by a non-technical person without previous training or experience by simply removing the cover 16 from the mounting layer 18 and pressing the adhesive face 20 against the wall 80 (FIG. 2) or the door 82 in such a fashion that door-wall alignment is created with the axis of the door stop assembly 10 substantially perpendicular to both the wall 80 and the door 82, independent of the structure to which the door stop assembly 10 is mounted.

For simplicity, let it be assumed that the door stop assembly 10 has been mounted as described (and is illustrated in FIG. 2) to the wall 80 so as to be substantially perpendicular to the wall 80 and the door 82. Thus, when the door 82 is caused to be moved from its closed position through the position of FIG. 2, the door 82 will strike the distal face 62 of the bumper 60 and the impact thereof will cause the dynamic member 14 to be axially displaced through part or all of the axial distance provided by the stop assembly for reciprocation. FIG. 3 illustrates the door stop assembly 10 in its fully retracted position. Once the door impact has been absorbed, the stop assembly 10 will return to its fully extended position (shown in FIG. 2).

Significantly, if the door stop assembly is mounted out of substantially perpendicular alignment with the door and the wall or if the dynamic member 14 is struck from the side, the lateral component of force will merely cause the barrel 36 to pivot about the guide structure 28, causing no damage to the door stop 10, the door 82 or the wall 80. When the lateral force is removed, the memory of spring 70 will cause the dynamic member 14 to resume its normal axial alignment with the static member 12.

The invention may be embodied in other specific forms without departing from the spirit or essential characteristics thereof. The present embodiment is therefore considered in all respects as illustrative and not restrictive, the scope of the invention being indicated by the appended claims rather than by the foregoing description, and all charges which come within the meaning and range of equivalency of the claims are therefore intended to be embraced therein.

What is claimed and desired to be secured by U.S. Letters Patent is:

1. A door stop assembly comprising:

a static mount member having a longitudinal axis and comprising means for anchoring the proximal end thereof to a wall, door or the like and first guide means;

a dynamic member normally having a longitudinal axis coaxial with the longitudinal axis of the static mount member and comprising impact bumper means at a cantilevered distal end thereof and second guide means forming at least one line contact with and biaxially cooperating with the first guide means, the second guide means comprising means accommodating and insuring (a) reciprocation of the dynamic member between extended and compressed positions in response to substantially axially imposed door impact as the door is opened and (b) substantially unrestrained pivoting of the dynamic member in respect to the static mount member through a substantial acute angle without binding in response to the imposition of lateral force upon the dynamic member either during or separate from said reciprocation so that the longitudinal axis of the dynamic member becomes disposed at an acute angle to the longitudinal axis of the static mount member;

means adjacent the guide means accommodating uninhibited passage of air between the atmosphere and the interior of the static mount member;

the two members being connected only by resilient bias means urging (a) the dynamic member toward its extended position and (b) the two members into axial alignment.

2. A door stop assembly according to claim 1 wherein the means for anchoring comprise impact-receiving seriatim adhesive means, resilient compressable means and rigid base means.

3. A door stop assembly according to claim 1 wherein the first guide means comprises a plurality of semicurvilinear flanges disposed at 90° to each other and the second guide means comprise a female receptacle into which the flanges snugly though reciprocably and pivotably extend in line contact.

4. A door stop assembly according to claim 1 wherein one of said guide means comprises male means and the other of said guide means comprises female means, linearly reciprocably and pivotably disposed in mating relation.

5. A door stop assembly according to claim 1 wherein the impact bumper means comprises an elastomeric stop insert press fit into an opening at the distal end of the dynamic member.

6. A door stop assembly according to claim 1 wherein said bias means comprises a helical compression spring spanning between and carried upon projections of the static mount member and the dynamic member, respectively.

7. A method of damping door impact without damage to doors, walls and door stops, comprising the steps of:

mounting the proximal end of a static member of a door stop so to be substantially perpendicular to planes respectively containing a wall and a door;

reciprocably and pivotably mounting a dynamic member of the door stop to the static member in male-female reciprocable and pivotable relation;

interposing guide structure between the static and dynamic members whereby linear reciprocation between the extended and compressed positions and non-aligned substantially unrestrained longitudinally directed line contact pivoting of the dynamic member through a substantial acute angle are both accommodated;

accommodating at all times uninhibited passage of air between the atmosphere and the interior of the static member;

biasing the dynamic member at all times toward its extended axially directed position;

displacing the dynamic member counter to the bias and toward its compressed position and/or its non-aligned pivoted position each time force is imposed upon the dynamic member; and returning the dynamic member to its extended axially directed position each time the force is removed.

* * * * *